United States Patent [19]

Barnay

[11] Patent Number: 4,755,943

[45] Date of Patent: Jul. 5, 1988

[54] COMMUNICATIONS SYSTEM BETWEEN A STATION ON THE SURFACE OF A LIQUID MEDIUM AND SUBMERGED CONTROL AND MONITORING MEANS OF A GROUP OF SUBMERGED WELL HEAD VALVES

[75] Inventor: Gilles Barnay, Serres-Castet, France

[73] Assignee: Societe Nationale Elf Aquitaine (Production), Paris, France

[21] Appl. No.: 872,843

[22] Filed: Jun. 11, 1986

[30] Foreign Application Priority Data

Jun. 11, 1985 [FR] France ..... 85 08800

[51] Int. Cl.[4] ..... G06F 3/04

[52] U.S. Cl. ..... 364/420; 251/26; 251/30.01; 364/900

[58] Field of Search ..... 137/237; 251/26, 30.01, 251/369; 364/900 MS File, 200 MS File; 166/420, 356

[56] References Cited

U.S. PATENT DOCUMENTS 4,047,159 9/1977 Boudry ..... 364/900
4,052,703 10/1977 Collins ..... 364/200
4,484,325 11/1984 Wilson ..... 370/60

FOREIGN PATENT DOCUMENTS 2105079 3/1983 United Kingdom .
2138249 10/1984 United Kingdom .

*Primary Examiner*—Jerry Smith
*Assistant Examiner*—Gail O. Hayes
*Attorney, Agent, or Firm*—Oblon, Fisher, Spivak, McClelland & Maier

[57] ABSTRACT

The invention relates to a system of communications between a station on the surface of a liquid medium and submerged control and monitoring means of a group of submerged well head valves remote from the station.

For each valve, the system comprises a control and monitoring module connected to an electrovalve and to sensors corresponding to said valve, transmission means connected to communications channels and to modules for simultaneously applying to said modules any control signals supplied by the station. The modules are connected to monitoring signal multiplexing means. The transmission means and multiplexing means are connected to the communications channels by switching means, which automatically select one of the channels in the case of an operating incident on the other channel.

Application to the control of submerged oil or gas well valves.

7 Claims, 3 Drawing Sheets

COMMUNICATIONS SYSTEM BETWEEN A STATION ON THE SURFACE OF A LIQUID MEDIUM AND SUBMERGED CONTROL AND MONITORING MEANS OF A GROUP OF SUBMERGED WELL HEAD VALVES

BACKGROUND OF THE INVENTION

The present invention relates to a communications system between a station on the surface of a liquid medium and submerged control and monitoring means of a group of submerged well head valves, such as those on oil or gas wells and which are remote from said station.

The invention more particularly applies to the control of the opening or closing of the valves of oil or gas well heads, which are submerged in a liquid, as well as to the monitoring of the operation of said valves from a control and monitoring station of the surface of the liquid medium.

A communications system between a station on the surface of a liquid medium and submerged means for the control and monitoring a group of submerged well head valves remote from this station is known. This system comprises a first communications channel having a first cable connected to the station and to the submerged control and monitoring means, as well as a second communications channel which can be a surface buoy or a cable close to the control and monitoring means. This buoy has means for hertzian communications with the station and it is connected by another communications cable to the submerged control and monitoring means. For each well head valve, said submerged control and monitoring means comprises at least one electrovalve for controlling the opening or closing of said valve, as well as sensors for monitoring the operation of said valves and the operation of the well head elements. The submerged control and monitoring means also comprise a submerged control and monitoring system connected to the electrovalves, to the sensors and to the two cables making it possible to establish communications with the station, either directly, or via the surface buoy. A communications system of this type is e.g. described in the journal Ocean Industry, February 1983, pp 47 to 50.

Generally, in systems of this type, the communications are synchronous, which is a serious disadvantage, particularly when there is a large attenuation of the amplitude of the control signals transmitted by the station to the submerged control and monitoring means. The loss of synchronization of the submerged control and monitoring means can lead to effects which are prejudicial to the satisfactory operation of the well head.

Another disadvantage of communications systems of this type is due to the fact that the choice of communications channel (cable or hertzian channel) is generally made on board the surface station. Switching from one communications channel to the other can take place at any time from the surface, because the switching relay on the ocean bed is controlled by a d.c. voltage from the surface and superimposed on the transmission by cable.

Another disadvantage results from the fact that the submerged monitoring and control means generally comprise a central unit and several peripheral units. This central unit permitting dialogue with surface equipments is an obligatory passage for the transmission to all the submerged equipments and is therefore highly prejudicial to the reliability of the system (common mode faults).

SUMMARY OF THE INVENTION

The problem of the present invention is to obviate these disadvantages and in particular to provide a communications system between a surface station and submerged means for the control and monitoring of a system of submerged well head valves in which the communications are of the asynchronous type, the choice of communications channel (by cable or hertzian channel) takes place automatically (e.g. in the case of the cable breaking), whereby all the submerged monitoring and control means units simultaneously receive a control signal, although this signal is in fact only intended for one of these units. The distribution of the signals to the different units takes place across a simplified unit (passive components only) which improve the reliability of the system (very few common mode faults).

The present invention therefore specifically relates to a communications system between a station on the surface of a liquid medium and submerged control and monitoring means for a group of submerged well head valves remote from the station, comprising a first communications channel by a first cable connected to the station and to the submerged control and monitoring means and a second communications channel by a cable or incorporating a surface buoy or a column close to the control and monitoring means, said buoy having means for hertzian communications with the station and which are connected by a second cable to the submerged control and monitoring means, the latter having for each valve, at least one electrovalve for controlling said valve, and monitoring sensors and for the system of valves, a control and monitoring system connected to the electrovalves, to the sensors and to the two communications cables, wherein the control and monitoring system comprises, for each valve, a control and monitoring module connected to the electrovalve and to the sensors corresponding to said valve and, for all the modules corresponding to the system or group of valves, transmission means connected to the communications channels and to the modules for simultaneously applying to said modules any control signal supplied by the station, the modules being connected by outputs to means for multiplexing the monitoring signals supplied by the outputs of the modules and resulting from signals supplied to these modules by the sensors, said multiplexing means being connected to the transmission channels, the control signal transmission means and the monitoring signal multiplexing means being connected to the transmission channels by switching means which automatically select the first channel in the case of a satisfactory operation of said first channel and automatically selecting the second channel in the case of an operating incident on the first channel.

According to another feature, the control signal transmission means comprise a first main transformer having a primary winding connected to the switching means and several secondary windings respectively connected to the modules for supplying thereto the control signals, the multiplexing means comprising a second main transformer having several primary windings respectively connected to the primary windings of first coupling transformers, primary windings of said first coupling transformers being respectively connected to the outputs of the modules, a secondary winding of the second main transformer being connected to the switching means for supplying multiplexed monitoring signals to the station.

According to another feature, each module comprises at least two identical control and monitoring chains or links connected to the electrovalve and to the sensors for monitoring the corresponding valve, each chain of each module being connected to the corresponding secondary winding of the first main transformer by a second coupling transformer to receive the control signals, the chains of each module being connected to the corresponding primary winding of the second main transformer by the first coupling transformers.

According to another feature, each chain of each module comprises a modem connected to the second corresponding coupling transformer for receiving the control signals and connected to the first coupling transformer for supplying the monitoring signals and a processing unit connected to the modem, to the electrovalve and to the sensors of the valve corresponding to said module.

According to another feature, each control signal supplied by the station comprises address data associated with control data, each processing unit having a predetermined address, the processing units simultaneously receiving each control signal and only the processing unit whose address corresponds to the address data contained in the control signal accepts the corresponding control data for applying a control signal to the electrovalve corresponding thereto.

According to another feature, the signal communications are of the asynchronous type.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
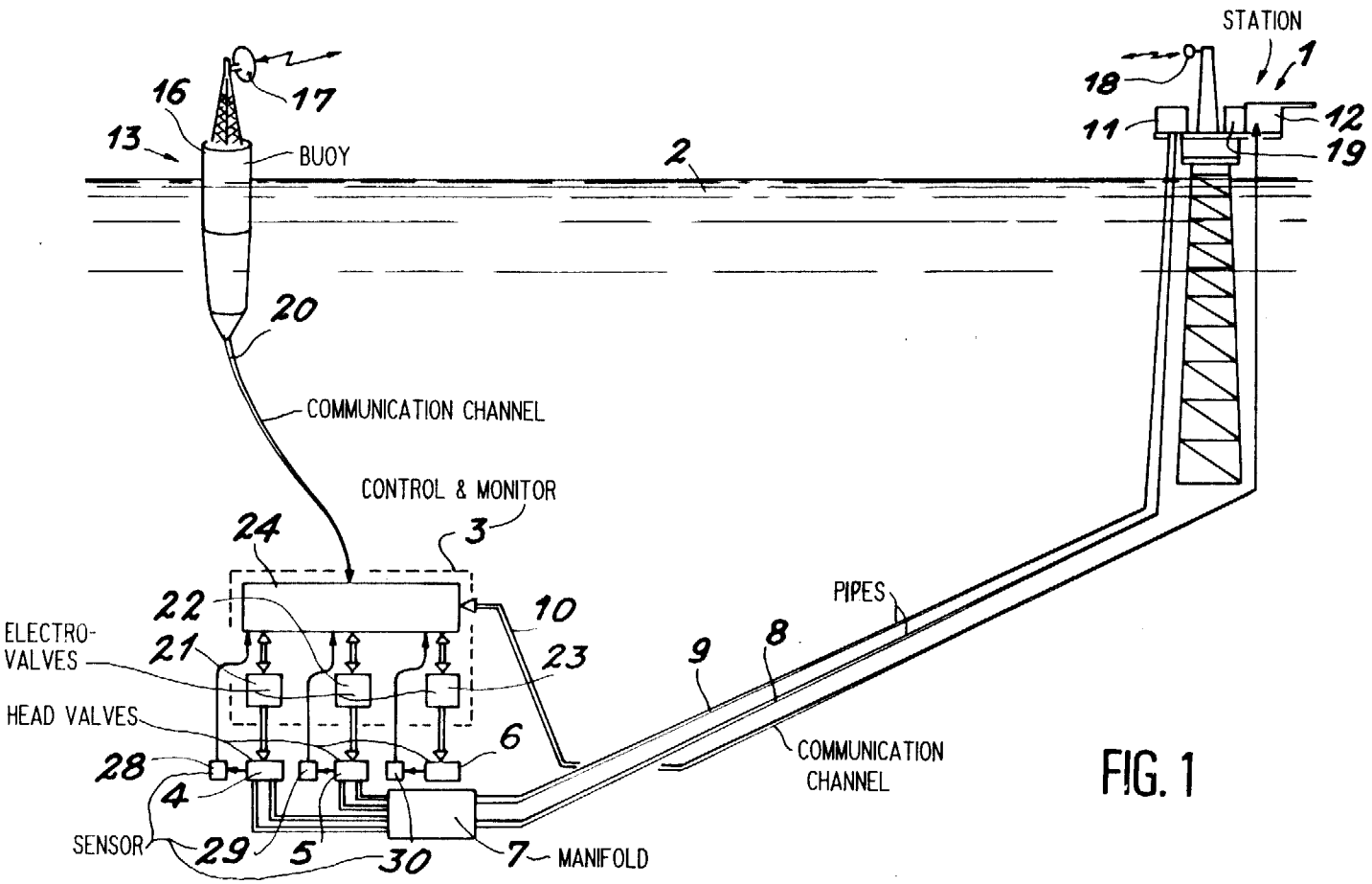
FIG. 1 Diagrammatically a communications system between a surface station and submerged control and monitoring means for the submerged well head valves.

FIG. 1 diagrammatically shows a system 1 according to the invention making it possible to establish communications between a station 1 on the surface of a liquid medium 2 and submerged control and monitoring means 3 of a group of submerged oil or gas well head valves 4, 5, 6 remote from station 1. The well head is not shown, but a manifold 7 is shown in exemplified manner with a control valve 6 for said manifold, which is connected to the well head valves 4, 5 and to the surface station 1 by pipes 8, 9 making it possible to transfer to said station the liquid or gas from the well, or inject into said well a liquid or gaseous fluid. The communications system comprises a first communications channel 10, constituted by a first cable, connected to station 1 and to the submerged control and monitoring means 3. Station 1 e.g. comprises liquid/gas storage means 11 and processing means 12, which are not shown in detail in the drawing. Means 12 supply control signals to the submerged control and monitoring means 3 and receive monitoring signals from said submerged means which process the signal supplied by the sensors. The communications system also comprises a second communications channel by cable or having a surface buoy or column 13 close to the control and monitoring means 3. This buoy has means 16, 17 establishing hertzian communications with the corresponding means 18, 19 of the station. The second communications channel also comprises a second cable 20 connected to the submerged means 3 and to the hertzian communication means 16, 17 carried by the buoy. For example, the submerged means 3 close to the well head can be at a depth of 300 meters, whilst the station 1 can be at a distance of 20 kilometers from the well head. The means 3 for the control and monitoring of valves 4, 5, 6 more particularly comprise electrovalves 21, 22, 23, respectively connected to said valves, as well as to a control and monitoring system, which is constituted by modules not shown in the drawings and which will be described in detail hereinafter. It is also possible to see the sensors 28, 29, 30 for monitoring the operation of valves 4, 5, 6. The control and monitoring system 24 is connected to the cables 10, 20 of each of the communications channels.

Figure 2A:
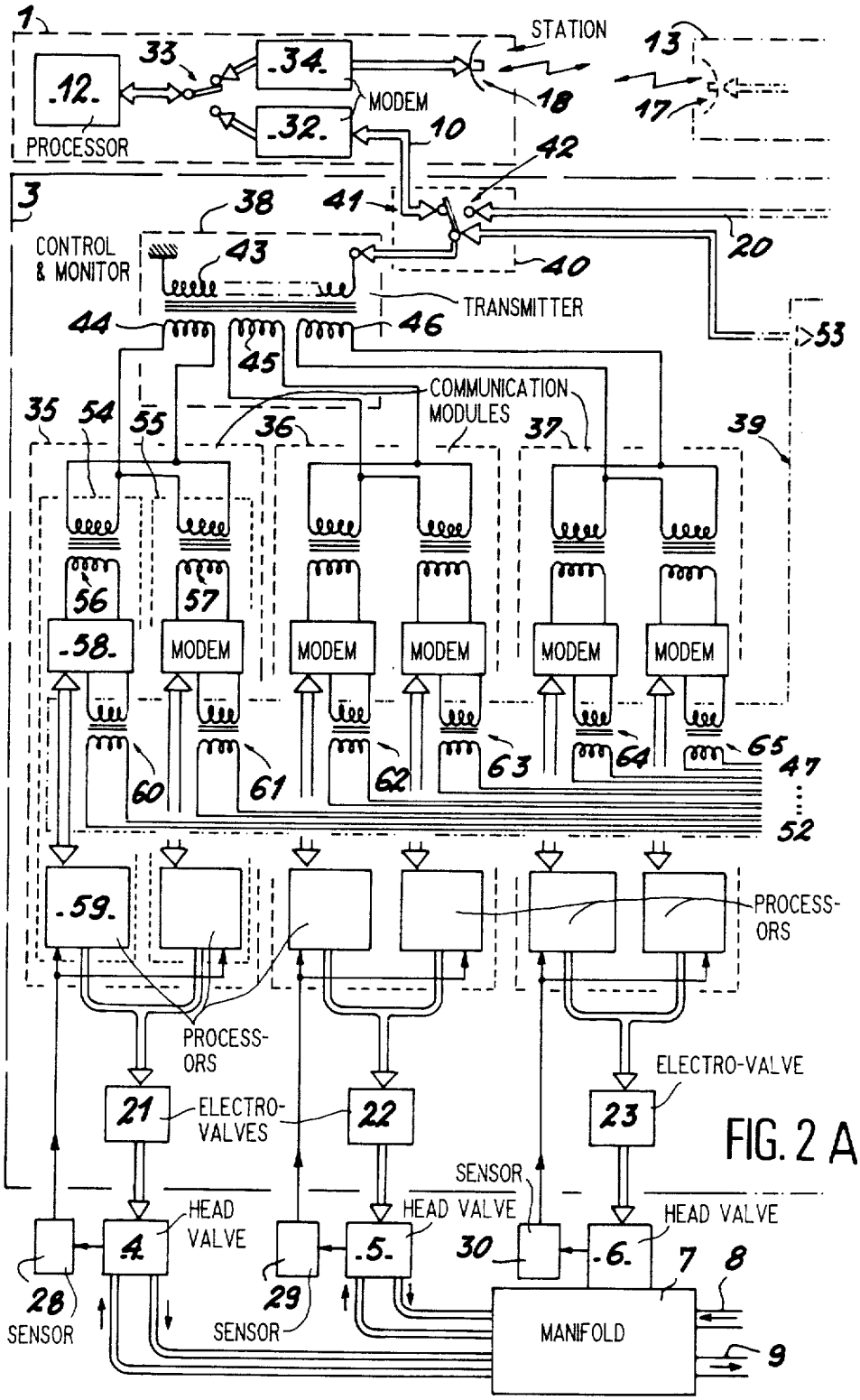
FIGS. 2A and 2B In greater detail the submerged control means.
Figure 2B:
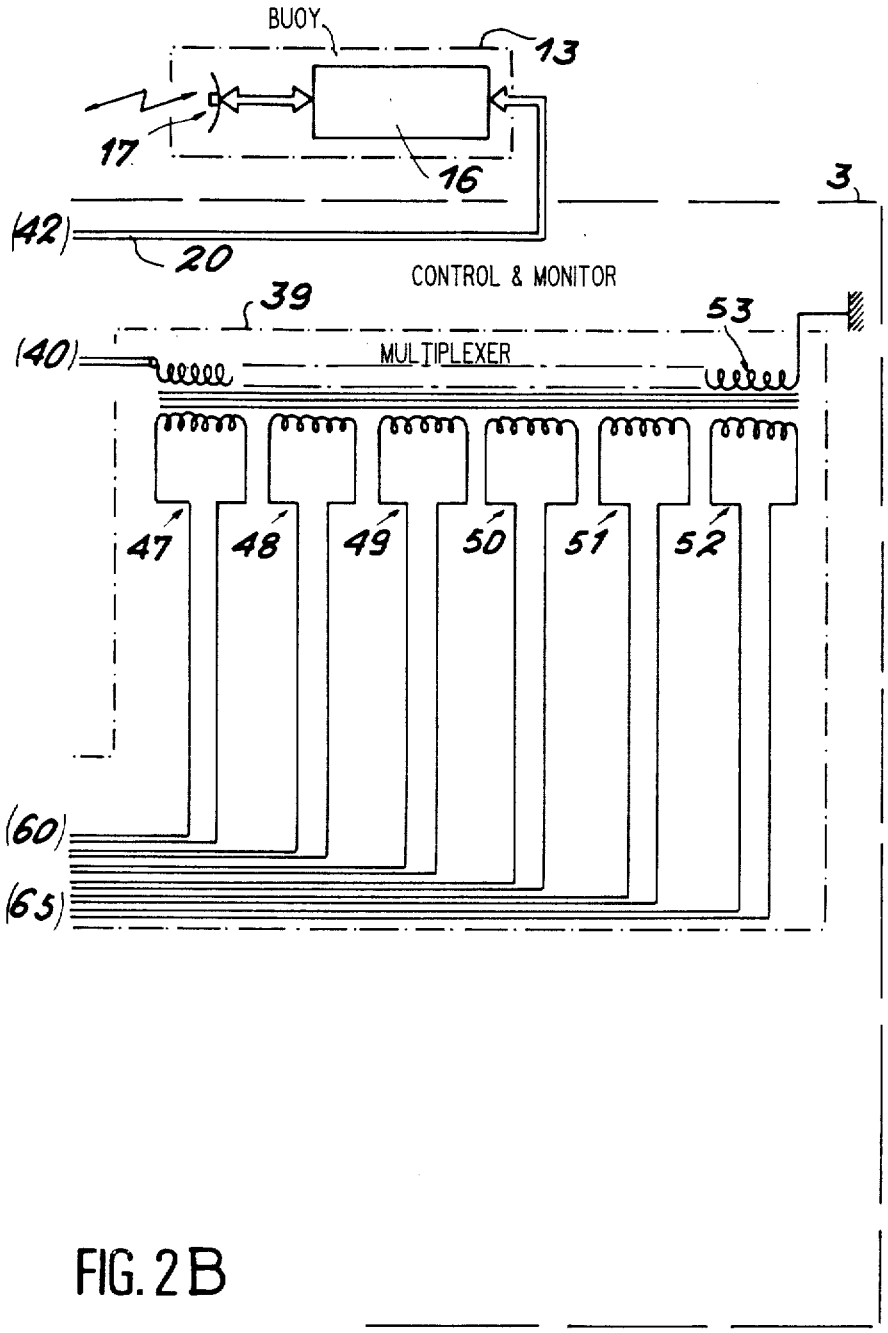

FIG. 2 shows in greater detail the communications system of FIG. 1. The same elements carry the same references as in FIG. 1. It is also possible to see the processing means 12 on board station 1 and which make it possible to control and monitor valves 4, 5, 6 via control and monitoring means 3. It is also possible to see the electrovalves 21, 22, 23 respectively connected to valves 4, 5, 6, as well as the monitoring sensors 28, 29, 30, which are connected to the control and monitoring means 3. The two communications channels between station 1 and the control and monitoring means 3 are also shown. The first channel comprises cable 10, which is connected to control means 3 and to processing means 12 of station 1, e.g. via a modem 32, as well as by switching means 33, which will be described hereinafter. The second channel more particularly comprises cable 20 connected to the hertzian communication means 16, 17 of buoy 13 and to the hertzian communications means 18, 34 of station 1. The communications means of buoy 13 e.g. comprise a transmitter-receiver 16 connected to antenna 17. In station 1, the hertzian communications means for the second channel, e.g. comprise a transmitter-receiver and a modem 34, which are not shown in detail here and which are connected to the communications means 33, as well as to antenna 18.

For each of these valves, the control and monitoring system 3 comprises a control and monitoring module connected to the corresponding electrovalve, as well as to the sensor corresponding to said valve. Electrovalve 21 and sensor 28 ae connected to module 35, whilst electrovalve 22 and sensor 29 are connected to module 36. Electrovalve 23 and sensor 30 are connected to module 37. These modules will be described in greater detail hereinafter. Only a single sensor per valve is shown in this drawing, but is obvious that each valve can have several sensors. Means 3 also comprise, for the group of modules 35, 36, 37 corresponding to the group of valves 4, 5, 6, transmission means 38 connected to the modules and to the aforementioned communicatins channels. These transmission means will be described in greater detail hereinafter and supply to all the modules simultaneously any control signals supplied by station 1. Finally, modules 35, 36, 37 are connected by outputs to multiplexing means 39 for the monitoring signal supplied by the outputs of the modules and resulting from signals applied to said modules by sensors 28, 29, 30. These multiplexing means are connected by outputs to the aforementioned transmission channels.

The transmission means 38 and the multiplexing means 39 are connected to two communications channels via switching means 40. The latter make it possible to automatically select the first communications channel (cable 10) in the case of a satisfactory operation of said first channel. They also make it possible to automatically select the second communications channel (cable 20 and hertzian channels), in the case of an operating incident on the first channel. The latter can e.g. be a breaking of cable 10 connecting means 3 to station 1 or a short-circuit in said cable. The switching means 40 can e.g. be constituted by a relay which, when the cable 10 is not broken, is automatically closed in position 41 and which, when the cable is broken, switches into position 42. When cable 10 is not broken, said relay e.g. permanently receives a d.c. voltage maintaining it in position 41, whereas when the cable is broken, as said d.c. voltage is no longer applied, the relay switches into position 42.

The means 38 for transmitting control signals to the electrovalves comprise a first main transformer having a primary winding 43 and several secondary windings 44, 45, 46 respectively connected to modules 35, 36, 37 for supplying thereto the control signals from processing means 12. The multiplexing means 39 comprise a second main transformer having several primary windings 47 yo 52 respectively connected to the secondary windings of first coupling transformers 60 to 65, the secondary windings of the first coupling transformers being respectively connected to the outputs of modules 35, 36, 37. The second main transformer also comprises a secondary winding 53 connected to the switching means 40 for supplying the processing means 12 of station 1 with multiplexed monitoring signals. The latter in fact result from monitoring signals from the sensors and which are processed in the corresponding modules.

Each module comprises at least two identical control and monitoring chains or links connected to the electrovalve and to the monitoring sensor of the corresponding valve. Thus, e.g. module 35 has at least two identical chains 54, 55, which will now be described in detail. The chains of the other modules are not shown in the drawings in order to simplify the representation thereof. These chains are identical to chains 54, 55 of the first module 35 and operate in the same way. Each chain is connected to the corresponding secondary winding of the first main transformer by a second coupling transformer to receive control signals from station 1. Chain 54 is also connected to the secondary winding 44 of main transformer 38 by a second coupling transformer 56. Chain 55 is connected to the secondary winding 44 of main transformer 38 by a transformer 57. Each module comprises several chains for safety reasons. Thus, if one of the chains is defective, the other chain which also receives the control signals from the station can transmit these signals to the corresponding electrovalve. The chains of each module are also respectively connected to the corresponding primary windings of the second main transformer 39 by first coupling transformers 60 to 65. Thus, chain 54 is connected to the primary winding 52 by the first coupling transformer 60, whilst chain 55 is connected to the primary winding 51 of transformer 39 by the coupling transformer 61.

Each chain comprises a modem 58 connected to the second corresponding coupling transformer 56 for receiving control signals. This modem is also connected to the second main transformer 39 by a first coupling transformer 60 for supplying the monitoring signals. Each chain also comprises a processing unit 59, connected to the modem 58, as well as to the corresponding electrovalve 21 and sensor 28.

Each control signal supplied by the processing means 12 of station 1 comprises address data associated with control data. Each of the processing units 59 of modules 35, 36 or 37 has a predetermined address. All the processing units simultaneously receive each control signal, but only the processing unit whose address corresponds to the address data contained in the control signal accepts said data and applies the control signal to the corresponding electrovalve. All the data transmissions in this communications system are of the asynchronous type.

The control and monitoring station 1 comprises, apart from the data processing system 12, the aforementioned switching means 33. The latter make it possible to connect the processing system 12 to one or other of the two communications channels. It automatically selects the first channel in the case of the satisfactory operation thereof and automatically selects the second channel in the case of an operating incident on the first channel. They can be constructed in the same way as switching means 40. These means can also be means programed to ensure communications on the first channel (cable 10) in the case of the satisfactory operation of the communications on said channel, whilst ensuring communications on the second channel in the case of a transmission incident on the first channel.

What is claimed is:

1. A communications system between a station on the surface of a liquid medium and submerged control and monitoring means for a group of submerged well head valves remote from the station, comprising a first communications channel connected by a first cable to the station and to the submerged control and monitoring means and a second communications channel comprising a surface buoy or a column close to the control and monitoring means, means for hertzian communications with the station, connected by a second cable to the submerged control and monitoring means, the control and monitoring means having for each valve, at least one electrovalve for controlling said valve, and monitoring sensors for each of the group of valves, a control and monitoring system connected to the electrovalves, to the sensors and to the two communications cables, wherein the control and monitoring system comprises, for each valve, a control and monitoring module connected to the electrovalve and to the sensors corresponding to said valve and, for all the modules corresponding to the group of valves, transmission means connected to the communications channels and to the modules, for simultaneously applying to said modules any control signal supplied by the station, the modules being connected by outputs to means for multiplexing monitoring signals supplied by the outputs of the modules and resulting from signals supplied to these modules by the sensors, said multiplexing means being connected to the transmission channels, outputs of transmission means and monitoring multiplexing means being connected to the transmission channels by switching means which automatically select the first channel in the case of a satisfactory operation of said first channel and automatically selecting the second channel in the case of an operating incident on the first channel.

2. A communications system according to claim 1, wherein the control signal transmission means comprise a first main transformer having a primary winding connected to the switching means and several secondary windings respectively connected to the modules for supplying thereto the control signals, the multiplexing means comprising a second main transformer having several primary windings respectively connected to the primary windings of first coupling transformers, primary windings of said first coupling transformers being respectively connected to the outputs of the modules, a secondary winding of the second main transformer being connected to the switching means for supplying multiplexed monitoring signals to the station.

3. A communications system according to claim 2, wherein each module comprises at least two identical control and monitoring chains or links connected to the electrovalve and to the sensors for monitoring the corresponding valve, each chain of each module being connected to the corresponding secondary winding of the first main transformer by a second coupling transformer to receive the control signals, the chains of each module being connected to the corresponding primary winding of the second main transformer by the first coupling transformers.

4. A communications system according to claim 3, wherein each chain of each module comprises a modem connected to the second corresponding coupling transformer for receiving the control signals and connected to the first coupling transformer for supplying the monitoring signals and a processing unit connected to the modem, to the electrovalve and to the sensors of the valve corresponding to said module.

5. A communications system according to claim 4, wherein each control signal supplied by the station comprises address data associated with control data, each processing unit having a predetermined address, the processing units simultaneously receiving each control signal and only the processing unit whose address corresponds to the address data contained in the control signal accepts the corresponding control data for applying a control signal to the electrovalve corresponding thereto.

6. A communications system according to any one of the claims 1 to 5, wherein the control and monitoring station comprises a data processing system connected to the two communications channels by other switching means which automatically select the first channel in the case of satisfactory operation thereof and automatically select the second channel in the case of an operating incident on the first channel.

7. A communications system according to any one of the claims 1 to 5, wherein the signal communications are of the asynchronous type.

* * * * *